United States Patent [19]

Takeda

[11] Patent Number: 5,014,674

[45] Date of Patent: May 14, 1991

[54] FUEL VAPOR CONTROL FOR AUTOMOTIVE VEHICLE ENGINE

[75] Inventor: Toshio Takeda, Hiroshima, Japan

[73] Assignee: Mazda Motor Corporation, Hiroshima, Japan

[21] Appl. No.: 303,341

[22] Filed: Jan. 30, 1989

[30] Foreign Application Priority Data

Jan. 30, 1988 [JP] Japan ..... 63-20778

[51] Int. Cl.[5] ..... F02M 39/00

[52] U.S. Cl. ..... 123/520; 123/519

[58] Field of Search ..... 123/520, 521, 516, 518, 123/519, 458

[56] References Cited

U.S. PATENT DOCUMENTS 4,630,581 12/1986 Shibata ..... 123/519
4,817,576 4/1989 Abe ..... 123/516

FOREIGN PATENT DOCUMENTS 0020669 1/1987 Japan ..... 123/519
0091959 2/1987 Japan ..... 123/519

*Primary Examiner*—Carl Stuart Miller
*Attorney, Agent, or Firm*—Fleit, Jacobson, Cohn, Price, Holman & Stern

[57] ABSTRACT

A vapor flow control apparatus which delivers fuel vapor from a vapor storate canister to an air intake chamber of an engine comprises a vapor flow control valve for increasingly delivering fuel vapor from the vapor storage canister into the air intake chamber according to an increase of intake air conducted into the air intake chamber, an acceleration detector for detecting an acceleration of the engine based on an increasing change of intake air conducted in the air intake pipe, and a control unit for controlling the vapor flow control valve to effect the increasing delivery of fuel vapor. The delivery of fuel vapor occurs lagging behind the increase of intake air when an acceleration of the engine is accelerated.

15 Claims, 6 Drawing Sheets

| |
|---|
| FIG. 2A |
| FIG. 2B |

FUEL VAPOR CONTROL FOR AUTOMOTIVE VEHICLE ENGINE

FIELD OF THE INVENTION

The present invention relates to a fuel vapor control apparatus of an automotive vehicle engine, and more particularly to a fuel vapor control apparatus which can prevent an excessive delivery of fuel vapor to an airstream in the air intake chamber of an automotive vehicle engine during an acceleration of the automotive vehicle engine.

BACKGROUND OF THE INVENTION

Various fuel vapor control apparatus are heretofore well known. One example of such apparatus which is disclosed in, for example, Japanese Utility Model Publication No. 61-23,644 entitled "Fuel Vapor Treatment Apparatus" published on July 15, 1986, includes a vapor flow control valve which delivers variably in amount fuel vapor from a vapor storage canister collecting fuel vapor produced in a fuel tank by an absorbtion process to the air intake chamber of an automotive vehicle engine. This vapor flow control valve acts to increasingly or decreasingly change the amount of fuel vapor passing therethrough and delivered to an intake airstream depending upon the amount of intake air flowing an intake air pipe. The provision of such a fuel vapor control apparatus enables the automotive engine to consume promptly the whole of fuel vapor in the vapor storage canister for the combustion of air-fuel mixture conducted in an engine combustion chamber. A decreased amount of fuel vapor delivered into the air intake chamber can highly improve the combustibility of air-fuel mixture upon delivery of a small amount of intake air into the air intake chamber which is caused while the automotive vehicle engine idles. On the other hand, the vapor storage canister can be always be ready for sufficiently collecting and storing even a large amount of fuel vapor from the fuel tank by delivering an increased amount of fuel vapor into the air intake chamber while engine load is high and a large amount of intake air is conducted, thereby preventing the vapor storage canister from being filled with fuel vapor to exceed its capacity and overflow and fuel vapor from emitting into the atmosphere.

Meanwhile, as is well known to those having an ordinary skill in the art, with an increase of the amount of intake air caused due to an increasing change of throttle valve opening during an acceleration of the automotive vehicle engine, a negative pressure of intake air flowing directly behind the throttle valve will not rapidly, but rather gradually, decrease or rise close to the atmospheric pressure and, in strict perspective, intake air flowing behind the throttle valve characteristically shows a retardation of the rise of pressure or a rise of pressure behind an increasing change of the amount of intake air, accordingly.

The above described fuel vapor control apparatus utilizing vapor control valves used hitherto has, on one hand, a significantly advantageous function to increasingly vary the available vapor flow depending upon an increase of the amount of intake air conducted in the intake air chamber while the engine is under acceleration but is, on the other hand, associated with a problem that an excessive amount of fuel vapor is delivered to air-fuel mixture at the beginning of engine acceleration as a result of a retarded rise in pressure of intake air.

This excessive delivery of fuel vapor will certainly impede a desired, ideal combustion of air-fuel mixture, resulting in a low operation efficiency of the engine.

SUMMARY OF THE INVENTION

It is, therefore, an object of the present invention to provide a fuel vapor control apparatus which can desirably control the amount of fuel vapor to be applied to air-fuel mixture even at the beginning of acceleration of an engine.

It is another object of the present invention to provide a fuel vapor control apparatus which can prevent application of an excessive amount of fuel vapor to air-fuel mixture when there is a delay of the rise of pressure of intake air relative to the increase of the amount of intake air flow.

According to the present invention, the above and the other objects can be accomplished by providing a fuel vapor control apparatus comprising a sensor such as an intake flow sensor or a throttle position sensor for detecting the amount of intake air flowing in an air intake pipe to provide an electric signal representative of the detected amount of intake air, a vapor pipe connected between a vapor storage canister and an air intake chamber of an automotive vehicle engine for delivering fuel vapor from the vapor storage canister to the air intake chamber, and control means for variably increasingly changing the amount of fuel vapor delivered to the air intake chamber according to increase of the intake air conducted into the air intake chamber. The control means includes valve means incorporated in the vapor pipe to variably change the amount of fuel vapor conducted into the air intake chamber. The control means may be a microcomputer and includes means for detecting the accelerating condition of the automotive vehicle engine based on the result of the detection of the amount of intake air and means for correctively controlling the electric operated valve means so as to cause the increasing change of the amount of fuel vapor lagging behind the increase of the amount of intake air.

In a preferred embodiment of the present invention, the valve means may be electrically operated at a duty rate varying according to the change of the amount of intake air. The duty rate is intentionally changed lower when the acceleration of the automotive vehicle engine is detected to retard the increasing change of fuel vapor delivered to the air intake chamber of the automotive vehicle engine.

BRIEF DESCRIPTION OF THE DRAWINGS

Still other aspect of the invention and more specific features will become apparent to those skilled in the art from the following description of the preferred embodiment considered together with the accompanying drawings in which.

DESCRIPTION OF THE PREFERRED EMBODIMENT

A fuel vapor control apparatus according to a preferred embodiment of the present invention is incorporated in an internal combustion engine of an automotive vehicle. Because such engines are well known, this description will be directed in particular to elements forming part of, or cooperating directly with, apparatus embodying the present invention. It is to be understood, however, that engine elements and its associated elements not specifically shown or described may take various forms known to those skilled in the art.

Figure 1:
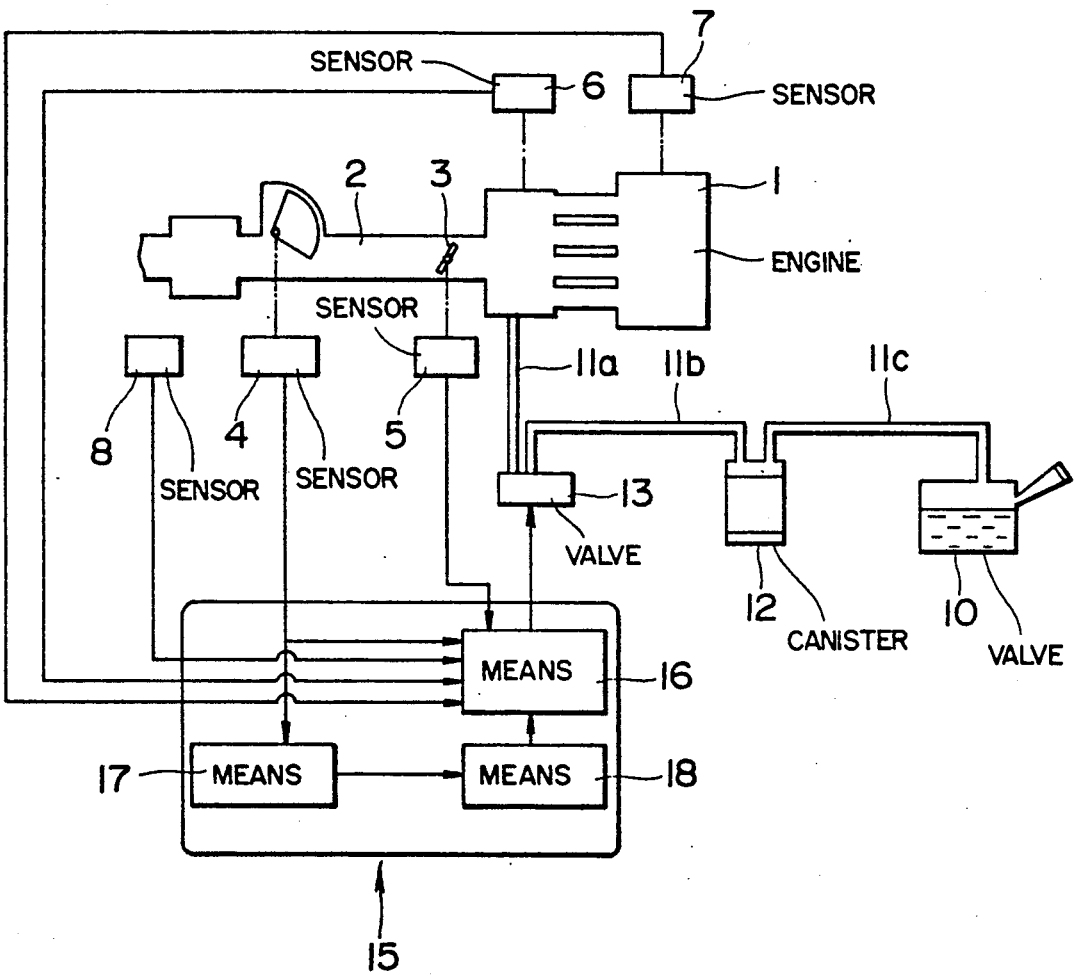
FIG. 1 is a diagrammatical illustration showing, partly in block, the fuel vapor control apparatus in accordance with a preferred embodiment of the present invention.

Referring now to the drawings, particularly to FIG. 1, a fuel vapor control apparatus according to the present invention is shown in cooperation with an automotive vehicle engine 1. As shown, the automotive vehicle engine 1 is attached with an air intake pipe 2 communicating with an air intake chamber thereof. A throttle valve 3 is placed in the air intake pipe 2 to control the amount of air reaching the cylinders of the automotive vehicle engine 1 and cooperated with a throttle opening or throttle position sensor and controlled by a linkage connected to an accelerator pedal in a well known manner. An air flow sensor 4 is provided having a spring loaded hinged flap or plate disposed in the air intake pipe 2 before the throttle valve 3 to measure the amount of intake air flowing to the air intake chamber of the engine 1.

The automotive vehicle engine 1 at the intake chamber is connected with a vapor pipe 11*a* through which fuel vapor is conducted from a fuel tank 10 through a vapor storage canister 12 connected by means of vapor pipes 11*b* and 11*c*. The vapor storage canister 12 contains a bed of activated charcoal or carbon for absorbing and collecting or storing fuel vapor from the fuel tank 10 and designed to close off the fuel vapor inlet communicated with the fuel tank 10 through the vapor pipe 11*c* and open the fuel vapor outlet communicated with the air intake chamber of the automotive vehicle engine 1 through the vapor pipes 11*a* and 11*b* so as to vent fuel vapor purge to a purge port of the air intake chamber of the automotive vehicle engine 1 with air purge.

An electric controlled intermittent valve 13, such as a solenoid valve, is provided between and connecting the vapor pipes 11*a* and 11*b* to vary the amount of fuel vapor passing therethrough from the vapor storage canister 12 to the intake air chamber of the automotive vehicle engine 1. The vapor flow control solenoid valve 13 is operated at different duty rates by means of a control unit 15 mainly comprising a microcomputer or central processing unit (CPU). In this sense, the electric operated vapor flow control solenoid valve 13 and the control unit 15 are referred to as a vapor flow controller. This control unit 15 includes means 16 for variably determining the duty rate at which the vapor flow control solenoid valve 13 is operated, means 17 for detecting the acceleration of the automotive vehicle engine 1, and means 18 for correctively changing the duty rate determined by the means 16. The duty rate determining means 16 is connected to outputs of various sensors, such as an air flow sensor 4, throttle valve position sensor 5, intake air temperature sensor 6, engine speed sensor 7, and atmospheric pressure sensor 8, all of which are well known in construction and operation to those skilled in the art and therefore need not be explained in detail therein.

Figures 2, 2A:
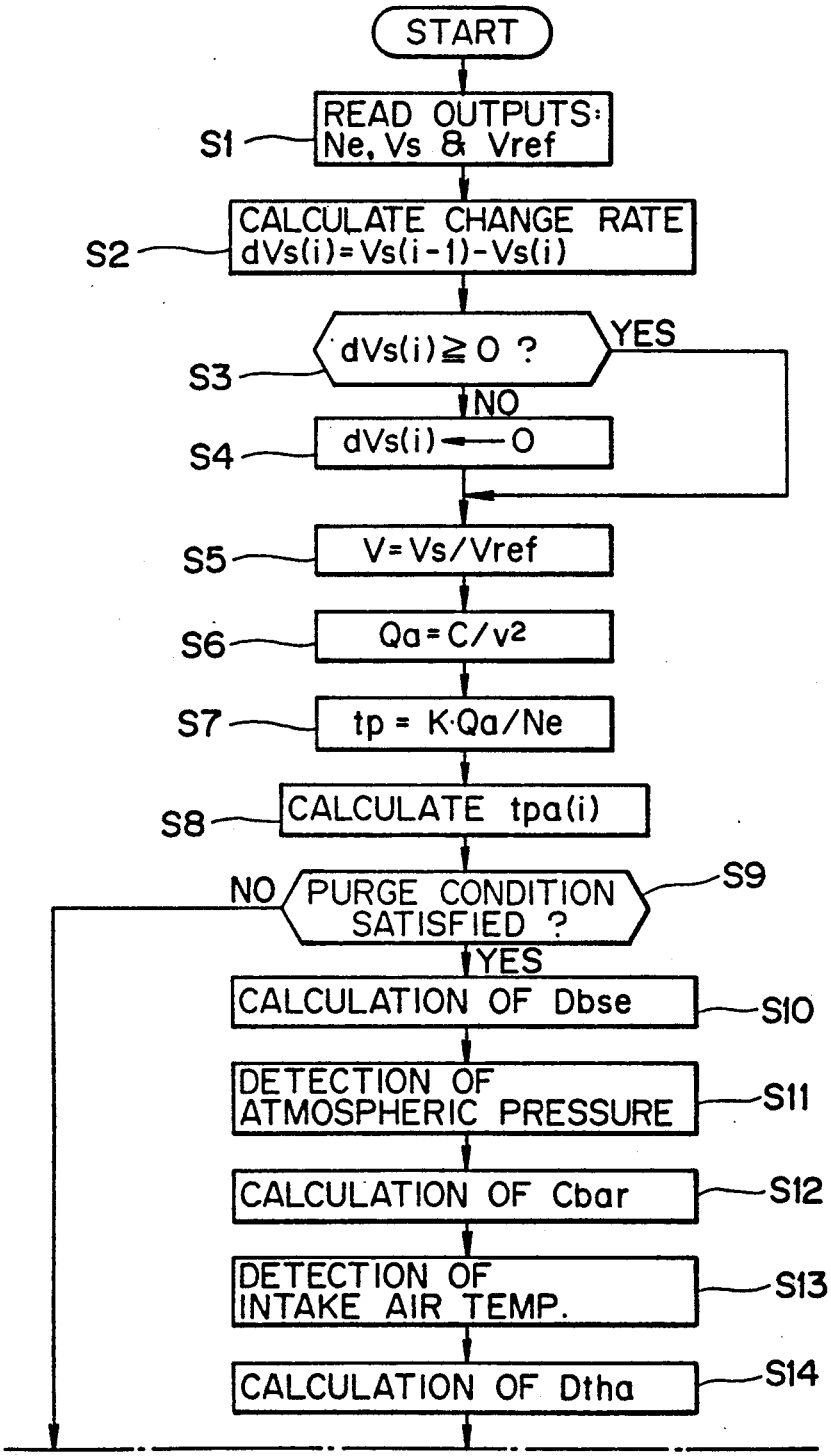
FIG. 2 is a schematic illustration showing the relationship of the flow chart shown in FIG. 2A and 2B.
FIG. 2A and 2B are a flow chart illustrating a general routine for a microcomputer which controls operation of the fuel vapor control apparatus in FIG. 1.

The vapor flow control solenoid valve 13 is controlled by the control unit 15 to correctively operate according to the sequence of operation illustrated in FIG. 2 to correctively vary the amount of fuel vapor delivered into the intake air chamber of the automotive vehicle engine 1 lagging behind the rapid change of the amount of intake air when the automotive vehicle engine 1 is accelerated as well as to change the amount of fuel vapor simultaneously accordingly to the change of the amount of intake air, based on the outputs from the air flow sensor 4 as well as from the engine speed sensor 7, intake air temperature sensor 6 and atmospheric temperature sensor 8.

The operation of the vapor flow control apparatus depicted in FIG. 1 is best understood by reviewing FIG. 2, which is a flow chart illustrating a general routine of the controlling the vapor flow control solenoid valve 13 for the microcomputer or CPU of the control unit 15. Programming a computer is a skill well understood in the art to prepare an appropriate program for the CPU. The particular details of any such program would of course depend upon the architecture of the particular computer selected.

Figure 2B:
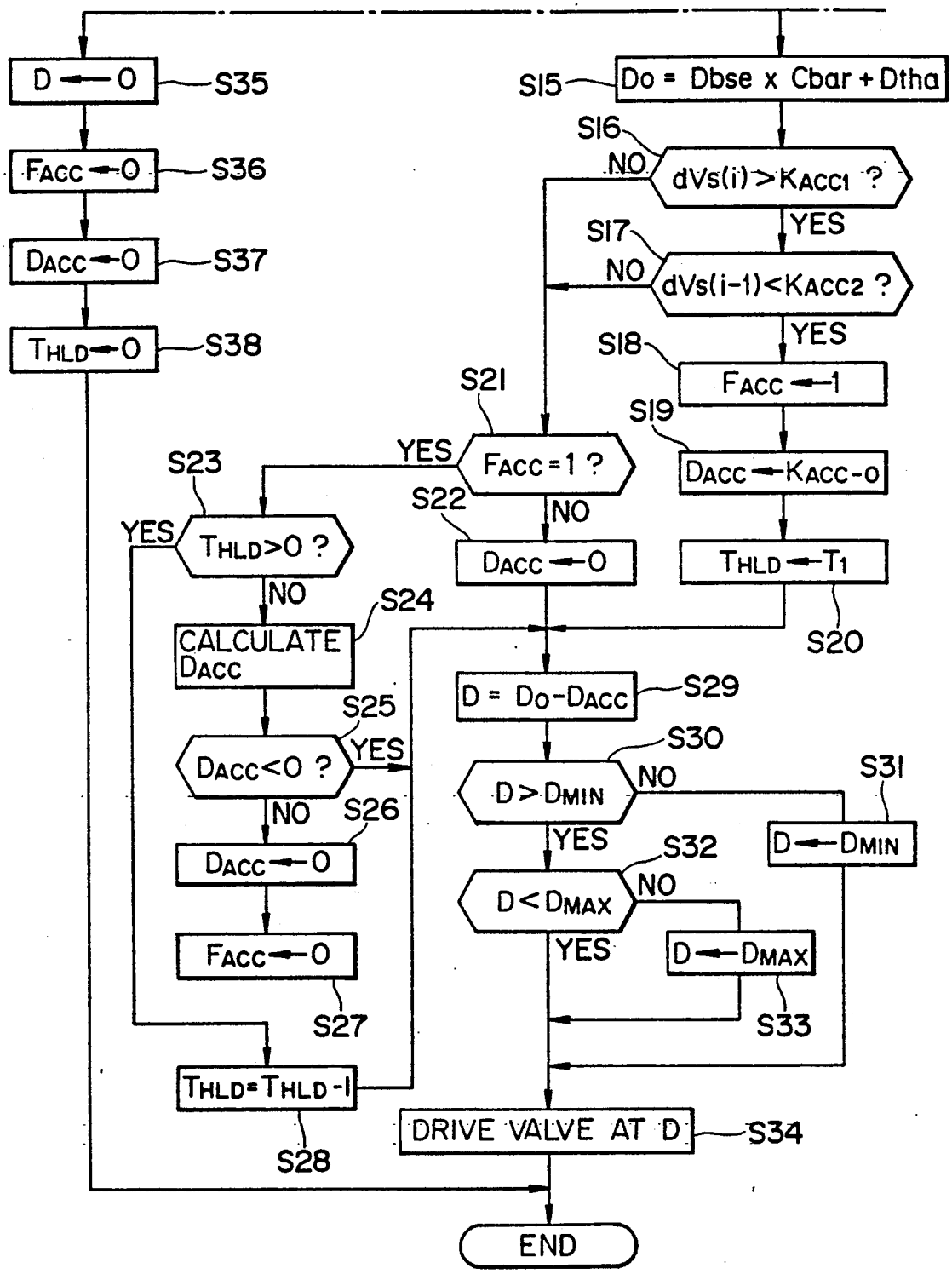
Figure 3A:
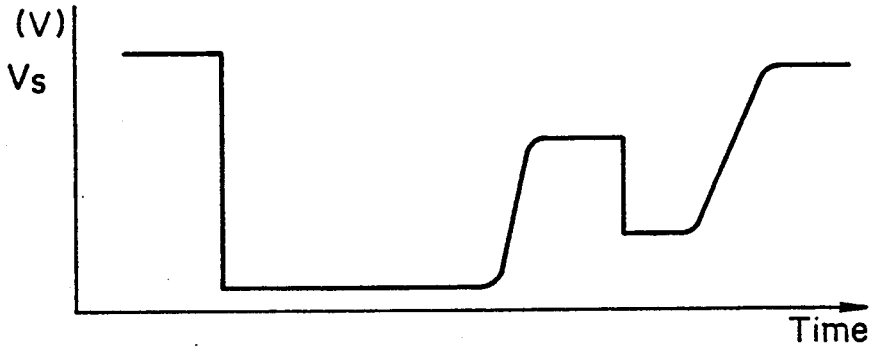
FIG. 3A is a diagram showing an example of output of an air flow sensor.
Figure 3B:
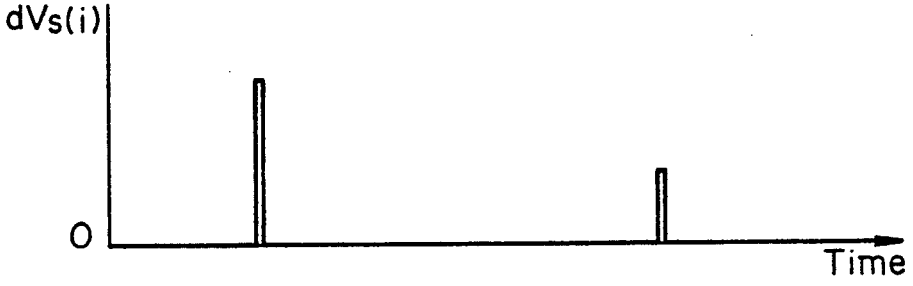
FIG. 3B is a diagram showing the amount of intake air at acceleration.
Figure 3C:
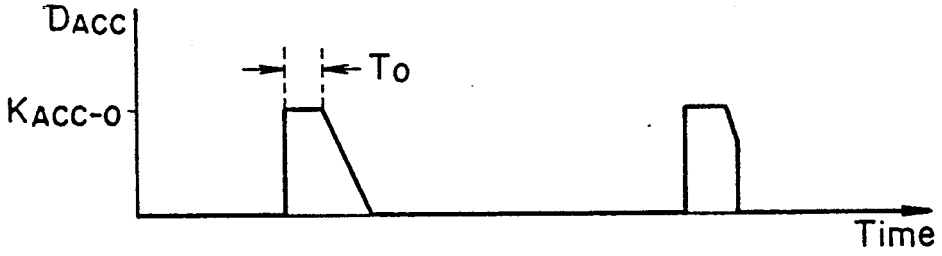
FIG. 3C is a diagram for correcting a duty rate at acceleration.

Referring to FIGS. 2A and 2B, the first step S1 is to read the condition of the air flow sensor 4 and engine speed sensor 7 to detect the amount of air flow Vs flowing in the air intake pipe 2 and the reference voltage Vref of the air flow sensor 4, and an engine speed Ne, respectively. All of the outputs of these sensors 4 and 7 are detected in the form of voltage. As is shown in FIG. 3A, the air flow sensor 4 provides its output in reverse proportion to the amount of intake air conducted in the air intake pipe 2. A rate of change of the amount of intake air dVs(i) at the present time is calculated as the difference between the present and last detected amounts Vs(i) and Vs(i−1) at step S2 and a first decision is made at step S3: "is the change rate dVs(i) equal or larger than zero (0)?" A parameter v is determined based on the output voltage Vs and reference voltage Vref of the air flow meter 4 at step S5 if the answer to the first decision is yes indicating the automotive vehicle engine 1 is under either a moderate or a rapid acceleration, or otherwise, after presuming the present change rate dVs(i) to be zero (0) at step S4 if the answer to the first decision is no. According to the parameter v determined at step S5 and the constant C depending upon the air flow sensor 4, a present amount of intake air Qa conducted in the air intake pipe 2 is determined at step S6. The CPU calculates a theoretical injection pulse width $t_p$ which is a measurement of how long a fuel injector is kept open. Using this theoretically calculated pulse width $t_p$, an effective injection pulse width $t_{pa(i)}$ is calculated from the following formula at step S8:

$$t_{pa(i)}=[K_A\times t_{pa(i-1)}+(256-K_A)\times t_{p(i)}]/256$$

In the formula, $K_A$ is a blunting coefficient and $t_{pa(i-1)}$ is the last effective injection pulse width.

The amount of fuel delivered by the injector depends upon the effective injection pulse width $t_{pa(i)}$. As is well known, injection pulse width is controlled by the CPU that constantly monitors engine speed, engine load, throttle positions or opening, exhaust, temperature, etc. Based on all these incoming signals the CPU is constantly adjusting pulse width so as to deliver a correct air-fuel ratio for any given engine demand.

Figure 4:
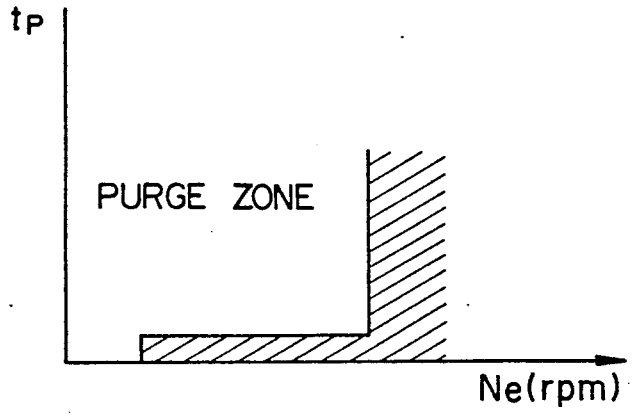
FIG. 4 is a diagram for determining the purge zone.
Figure 5:
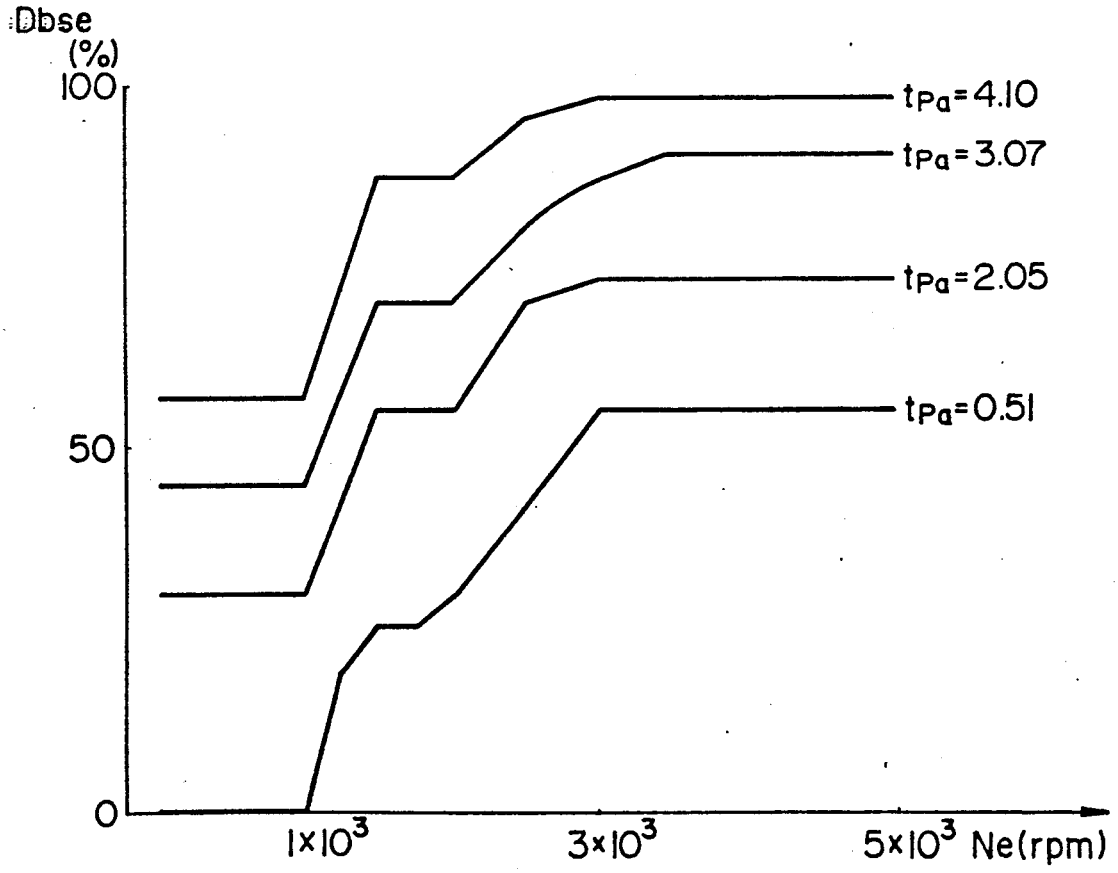
FIG. 5 is a diagram for determining a basic duty rate which is used for calculating an effective control duty ratio.
Figure 6:
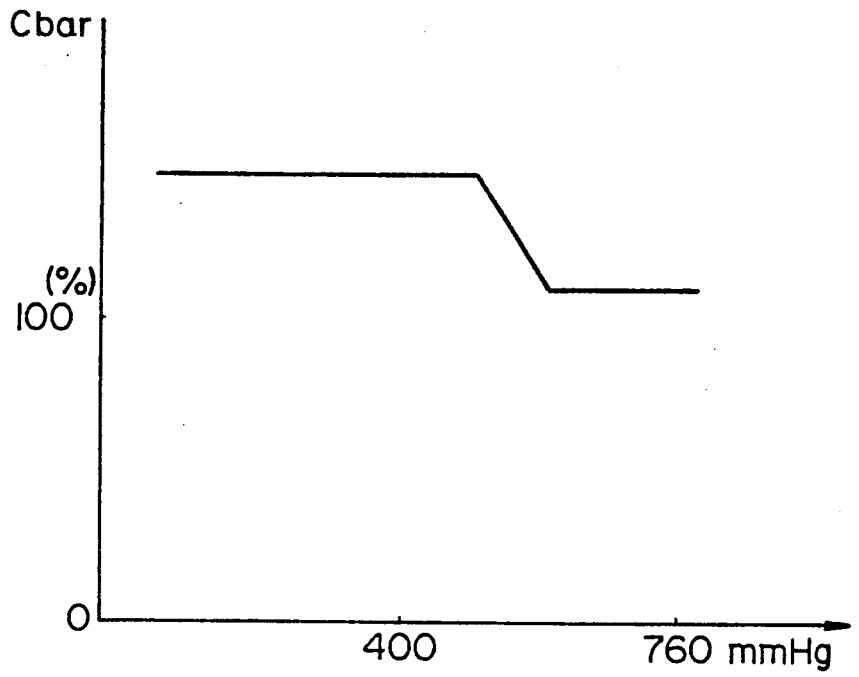
FIG. 6 is a diagram for determining a correction value of atmospheric pressure.
Figure 7:
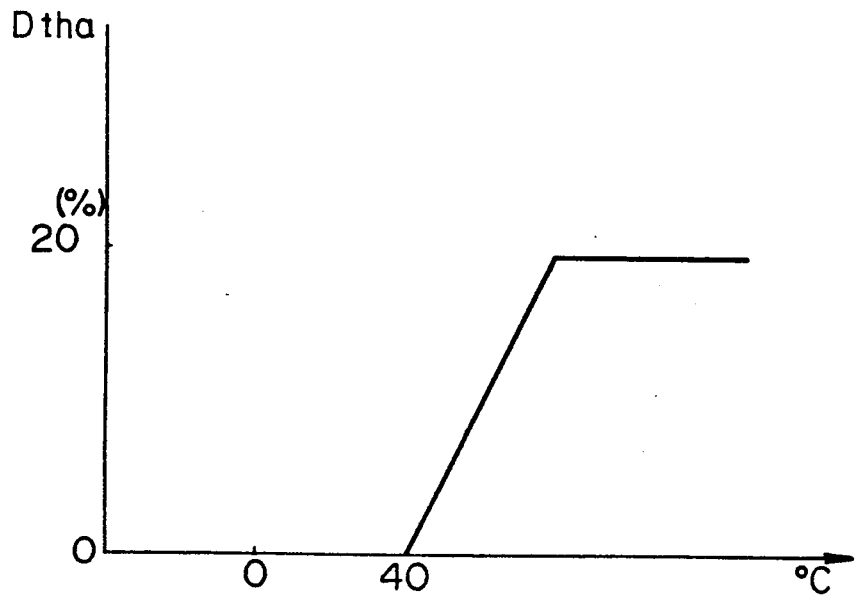
FIG. 7 is a diagram for determining a correction value of intake air temperature.

Thereafter, a second decision is made with reference to a purge condition map shown in FIG. 4 at step S9: "is a purge condition satisfied?" This second decision is made regarding whether the combination of the engine speed Ne and theoretical injection pulse width $t_p$ is within the purge zone of the purge condition map. If the answer to the second decision is yes, a basic duty rate $D_{bse}$ is determined based on the engine speed Ne and the effective injection pulse with $t_{pa}$ using a map means that the CPU comprises at step S10. The basic duty rate Dbse is obtained on a basic duty rate map including four duty rate curves according to the effective injection pulse width $T_{pa}$, such as shown in FIG. 5. Then, the CPU reads the present output of the atmospheric pressure sensor 8 to detect the atmospheric pressure at step S11 so as to calculate an atmospheric pressure correction value Cbar using a function that is graphed in FIG. 6 at step S12 and then, reads the intake air temperature sensor 6 to detect an intake air temperature at step S13 so as to calculate an intake air temperature correction value Dtha according using a function that is graphed in FIG. 7 at step S14. Thereafter, based on the calculated correction values Cbar and Dtha and the basic duty rate Dbse, a control duty rate Do is determined at step S15. The vapor flow control solenoid valve 13 is controlled at the control duty rate Do to provide a desired amount of fuel vapor basically corresponding to the amount of intake air conducted into the intake air pipe 2 under the control of the throttle valve 3. After the determination of the effective control duty rate Do at step S15, a decision is made at step S16: "is the present change rate of intake air flow dVs(i) over a predetermined upper limit of change rate $K_{ACC1}$?" If the answer to the decision at step S16 is yes another decision is made at step S17: "is the last change rate of intake air flow dVs(i−1) lower than a predetermined lower limit of change rate $K_{ACC2}$. If the answer to the decision at step S17 is yes, this normally indicates that the increase of the amount of intake air is rapid or the automotive vehicle engine 1 is under acceleration. Then, an engine acceleration flag $F_{ACC}$="1" is set at step S18 and an acceleration duty correction value $D_{ACC}$ is fixed to a predetermined or preselected initial value $K_{ACC\text{-}0}$ at step S19. Thereafter, a counter $T_{HLD}$ assumes a predetermined or preselected certain count $T_1$ at step S20 to count a predetermined time period To from the beginning of acceleration. In this event, an effective control duty rate D is obtained as the difference between the control duty rate Do and the acceleration duty correction value $D_{ACC}$ at step S29.

If the answer to either decision at step S16 or S17 is no, this indicates that the increasing change of the amount of intake air is moderate and therefore the automotive vehicle engine 1 is under non-acceleration. Then, a decision is made at step S21: "has the flag $F_{ACC}$="1" been set?" If the answer to the decision regarding engine acceleration is no, the acceleration duty correction value $D_{ACC}$ is established as zero (0%) at step S22. Otherwise, a yes decision indicates the automotive vehicle engine 1 is under acceleration. Then, a decision regarding the count of the counter $T_{HLD}$ is made at step S23: "is the counted value $T_{HLD}$ is larger than zero (0)?" If the answer is no, indicating that the predetermined time period To from the beginning of acceleration has elapsed, then the acceleration duty correction value $D_{ACC}(=D_{ACC-DACC-D})$ is calculated by subtracting an attenuation value of $D_{ACC-D}$ at step S24. If the resultant acceleration duty correction value $D_{ACC}$ is judged smaller than zero (0%) at step S25, then, the non-acceleration flag $F_{ACC}=0$ is set at step S27 after presuming the acceleration duty correction value $D_{ACC}$ as to be zero (0) at step S26. Otherwise, the yes decision regarding the counted value $T_{HLD}$ at step S23 indicates that the time period To from the beginning of acceleration has not yet elapsed, and then the counter $T_{HLD}$ is decremented by one (1) count at step S28. In either event, the effective control duty rate D is obtained as a difference between the control duty rate Do and the acceleration duty correction value $D_{ACC}$ at step S29.

The effective control duty rate D thus obtained is compared with the minimum controllable duty rate $D_{MIN}$ at step S30 and with the maximum controllable duty rate $D_{MAX}$ at step S32. If in fact the effective control duty rate D is between the minimum and maximum controllable duty rates, the vapor flow control solenoid valve 13 is controlled at the effective control duty rate D. However, if the effective control duty rate D is out of the limits or the minimum and maximum controllable duty rates $D_{MIN}$ and $D_{MAX}$, the vapor flow control solenoid valve 13 is controlled at the minimum controllable duty rate $D_{MIN}$ or the maximum controllable duty rate $D_{MAX}$ as which the effective control duty rate D is presumed at step S31 or S33, respectively.

In the event of the no decision at step S9 indicating that any purge condition is not satisfied, the effective control duty rate D is presumed as zero (0) at step S35 and the non-acceleration flag $F_{ACC}=0$ is set at step S36. Then, the acceleration duty correction value $D_{ACC}$ and the count of the counter $T_{HLD}$ are both presumed to be zero (0) at steps S37 and S38, respectively.

As apparent from the above description, in the above embodiment, the acceleration detection means 17 of the control unit 15 decides the acceleration of the automotive vehicle engine 1 by detecting the change rate of intake air dVs exceeding a predetermined value represented by the threshold values $K_{ACC}$ at steps 16 and 17. When the automotive vehicle engine 1 is determined to be under acceleration, the duty rate changing means 18 of the control unit 15 changes the basic duty rate Dbse according to a demand of retardation from the acceleration detection means 17 to an effective control duty rate D by subtracting the acceleration duty correction value $D_{ACC}$ from the control duty rate Do in the duty rate determining means 16. By operating the vapor flow control solenoid valve 13 at the effective control duty rate D shown by a dashed line in FIG. 3D, the amount of fuel vapor delivered through the vapor pipe **11*a* is gradually increasingly varied according to but lagging behind the increase of the amount of intake air flow conducted into the air intake pipe 2. When the automotive vehicle engine is ordinarily operated without acceleration, the vapor flow control solenoid valve 13 is controlled to operate at the control duty rate Do so as to increasingly or decreasingly vary the amount of fuel vapor delivered through the vapor pipe 11***a* according to and rapidly responding to the increase or decrease of the amount of intake air flow conducted into the air intake pipe 2.

Therefore, in the case of a lesser amount of intake air conducted into the intake air chamber, such as when the automotive vehicle engine 1 idles, a decreased amount of fuel vapor is delivered into the air intake chamber so that a gratifying combustibility of air-fuel mixture can be obtained. Furthermore, because of the delivery of an increased amount of fuel vapor into the air intake chamber while the automotive vehicle engine 1 is operated under high engine loads and a large amount of intake air flow is accordingly conducted, the vapor storage canister 12 can be always made ready for sufficiently collecting and storing a large amount of fuel vapor from the fuel tank 10 so as to thereby prevent the vapor storage canister 12 from being filled with fuel vapor to overflow and the fuel vapor from being exhausted into the atmosphere.

Figure 3D:
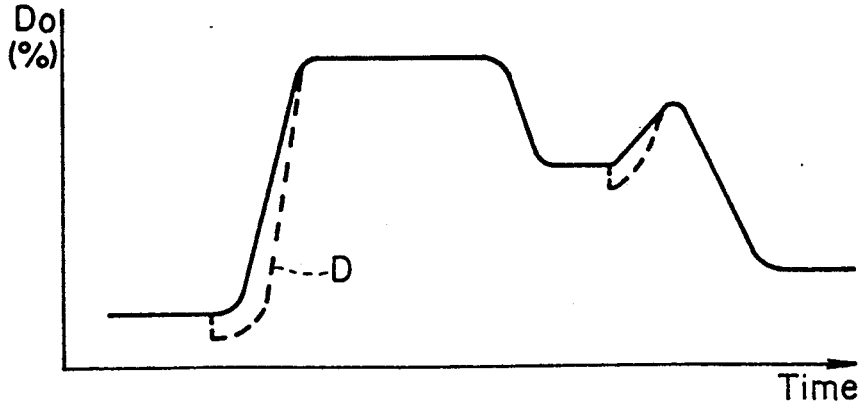
FIG. 3D is a diagram showing an example of duty control in accordance with the present invention.

On the other hand, when the change rate of the amount of intake air becomes larger than the predetermined value, that is, when the engine is accelerated, the vapor flow control solenoid valve 13 is controlled to operate at a corrected effective control duty rate D shown by dashed a in FIG. 3D. The corrected effective control duty rate D is reduced by the correction value $D_{ACC}$ which is constant during the predetermined time period To from the beginning of acceleration but gradually decreases after the predetermined time period To, so that the automotive vehicle engine 1 is prevented from receiving an excessive amount of fuel vapor under acceleration.

The vapor flow control means may take any other valve means in place of the electric controlled duty solenoid valve operable at different duty rate. For example, an electric controlled valve may be utilized to vary the cross sectional area of the vapor pipe according to the amount of intake air conducted into the air intake pipe. Furthermore, for detecting the change of the amount of intake air, it is permissible to use the throttle position sensor.

Although the present invention has been fully described by way of the preferred embodiment thereof with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. A vapor flow control apparatus for delivering fuel vapor from a vapor storage canister to an air intake chamber of an automotive vehicle engine, said apparatus comprising:

acceleration detecting means for detecting an increasing change of the amount of intake air conducted in an air intake pipe to thereby detect an accelerated of said automotive vehicle;

a vapor pipe connected between said vapor storage canister and said air intake chamber for delivering fuel vapor from said vapor storage canister to said air intake chamber;

vapor flow control means including electrically controlled valve means disposed in said vapor pipe for variably delivering fuel vapor according to said increasing change of the amount of intake air; and control means for controlling said vapor flow control means to force an increasing delivery of fuel vapor to lag behind said increasing change of the amount of intake air conducted into said air intake chamber when said acceleration detecting means detects an acceleration of said automotive vehicle engine.

2. A vapor flow control apparatus for delivering fuel vapor from a vapor storage canister to an air intake chamber of an automotive vehicle engine, said apparatus comprising:

vapor flow control means for increasingly delivering fuel vapor from said vapor storage canister into said air intake chamber according to an increase of the amount of intake air conducted into said air intake chamber;

acceleration detecting means for detecting an acceleration of said automotive vehicle engine based on an increasing change of intake air conducted in an air intake pipe; and control means for controlling said vapor flow control means to force an increasing delivery of fuel vapor to lag behind said increasing change of the amount of intake air conducted into said air intake chamber when said acceleration detecting means detects an acceleration of said automotive vehicle engine.

3. An apparatus as defined in claim 2, wherein said vapor flow control means is an electric operated solenoid valve operable at different duty rates to change the amount of fuel vapor delivered therethrough.

4. An apparatus as defined in claim 3, wherein a duty rate is basically obtained as a function of an engine speed and an injection pulse width calculated based on an amount of intake air conducted in said air intake pipe and said engine speed.

5. An apparatus as defined in claim 3, wherein said vapor flow control means is controlled to shut off fuel vapor when an engine speed is higher than a predetermined high speed.

6. An apparatus as defined in claim 3, wherein said vapor flow control means is controlled to shut off fuel vapor when said automotive vehicle engine is under deceleration.

7. An apparatus as defined in claim 3, wherein said vapor flow control means is controlled to shut off fuel vapor when said automotive vehicle engine is in a fuel cut-off zone.

8. An apparatus as defined in any one of claim 3, wherein a duty rate is continuously reduced at a constant rate when said acceleration detecting means detects an acceleration of said automotive vehicle engine.

9. An apparatus as defined in claim 8, wherein said duty rate is reduced by a predetermined fixed rate for a predetermined time period from the beginning of said acceleration of said automotive vehicle engine.

10. An apparatus as defined in claim 9, wherein the more rapid said acceleration of said automotive vehicle engine is the larger said predetermined fixed rate is.

11. An apparatus as defined in any one of claim 3, wherein the higher a temperature of said intake air is the more a duty rate is reduced.

12. An apparatus as defined in claim 3, wherein the lower a temperature of an engine coolant is the more a duty rate is reduced.

13. An apparatus as defined in claim 2, wherein said acceleration detecting means includes an air flow sensor to detect the amount of intake air conducted in said air intake pipe.

14. An apparatus as defined in claim 2, wherein said acceleration detecting means includes a throttle valve position sensor to detect an operated position of a throttle valve so as to detect the amount of intake air to be conducted in said air intake pipe.

15. An apparatus as defined in claim 3, wherein said vapor flow control means is an electric controlled valve so operated as to change an effective cross sectional area of a vapor pipe connecting said vapor storage canister to said automotive vehicle engine.

* * * * *